US011598139B2

(12) United States Patent
Bendefy

(10) Patent No.: US 11,598,139 B2
(45) Date of Patent: Mar. 7, 2023

(54) DRIVE DEVICE FOR MOVING A MOVABLE PART OF A PIECE OF FURNITURE, AS WELL AS A FITTING ARRANGEMENT AND A PIECE OF FURNITURE WITH SUCH A DRIVE DEVICE

(71) Applicant: Flap Competence Center Kft, Budapest (HU)

(72) Inventor: Andras Bendefy, Budapest (HU)

(73) Assignee: Flap Competence Center Kft, Budapest (HU)

( * ) Notice: Subject to any disclaimer, the term of this patent is extended or adjusted under 35 U.S.C. 154(b) by 207 days.

(21) Appl. No.: 17/146,519

(22) Filed: Jan. 12, 2021

(65) Prior Publication Data

US 2021/0222475 A1 Jul. 22, 2021

(30) Foreign Application Priority Data

Jan. 17, 2020 (EP) ..... 20152336

(51) Int. Cl.
*E05F 5/06* (2006.01)
*E05F 15/622* (2015.01)

(52) U.S. Cl.
CPC ..... *E05F 15/622* (2015.01); *E05F 5/06* (2013.01); *E05Y 2201/224* (2013.01); *E05Y 2900/20* (2013.01)

(58) Field of Classification Search
CPC .. E05Y 2900/20; E05Y 2201/224; E05F 5/06; E05F 15/622
See application file for complete search history.

(56) References Cited

U.S. PATENT DOCUMENTS 4,449,263 A 5/1984 Wilson et al.
8,677,568 B2 3/2014 Sutterlutti
(Continued)

FOREIGN PATENT DOCUMENTS

CN 203285212 11/2013
CN 205314773 6/2016
(Continued)

OTHER PUBLICATIONS

First Examination Report issued in Indian counterpart Application No. 202014056134, dated Aug. 31, 2021.

*Primary Examiner* — David M Fenstermacher
(74) *Attorney, Agent, or Firm* — Burris Law, PLLC

(57) ABSTRACT

A drive device for moving a movable part of a piece of piece of furniture between a closed position and an open position includes a motor pivotably connectable to a body of the piece of furniture via a support assembly, a first threaded element rotatably drivable by the motor, and a second threaded element engaged with said first threaded element. The second threaded element is translationally displaced along the first threaded element upon rotation of the first threaded element. An actuating element having a first stop and a second stop is included and is arranged displaceably relative to the first threaded element along an axis of motion. The second threaded element is arranged axially displaceably relative to the actuating element between the first stop and the second stop of the actuating element. Also, a fitting element pivotally connected to the actuating element and connectable to the movable furniture part is included.

20 Claims, 7 Drawing Sheets

(56) References Cited

U.S. PATENT DOCUMENTS

| | | | | |
|---|---|---|---|---|
| 2009/0293655 | A1* | 12/2009 | Tseng | F16H 25/2015 74/89.37 |
| 2012/0222509 | A1* | 9/2012 | Winther | F16H 25/20 74/89 |
| 2014/0338480 | A1* | 11/2014 | Wu | F16H 25/20 74/89.23 |
| 2017/0324301 | A1* | 11/2017 | Jørgensen | H05K 5/0204 |
| 2018/0031091 | A1* | 2/2018 | Wu | F16H 25/20 |
| 2018/0097422 | A1* | 4/2018 | Gassner | H02K 7/116 |
| 2018/0209201 | A1 | 7/2018 | Schimon | |
| 2020/0008991 | A1* | 1/2020 | Wu | F16F 9/103 |
| 2022/0221035 | A1* | 7/2022 | Schewe | A61G 7/018 |

FOREIGN PATENT DOCUMENTS

| | | |
|---|---|---|
| CN | 105840035 | 8/2016 |
| CN | 207315097 | 5/2018 |
| CN | 110159127 | 8/2019 |
| CN | 209413651 | 9/2019 |
| CN | 110656839 | 1/2020 |
| CN | 110685524 | 1/2020 |
| DE | 202010016982 | 4/2012 |
| DE | 202015107036 | 5/2017 |
| DE | 202018104555 | 9/2018 |
| EP | 2669458 | 12/2013 |
| KR | 1020180036990 | 4/2018 |
| RU | 2726097 | 7/2020 |
| SU | 1384699 | 3/1988 |

* cited by examiner

DRIVE DEVICE FOR MOVING A MOVABLE PART OF A PIECE OF FURNITURE, AS WELL AS A FITTING ARRANGEMENT AND A PIECE OF FURNITURE WITH SUCH A DRIVE DEVICE

CROSS-REFERENCE TO RELATED APPLICATIONS

This application claims priority to and the benefit of EP 20152336.2, filed on Jan. 17, 2020. The disclosures of the above applications are incorporated herein by reference.

FIELD

The present disclosure relates to a drive device for moving a movable part of a piece of furniture between a closed and an open position as well as a fitting arrangement and a piece of furniture with such a drive device.

BACKGROUND

The statements in this section merely provide background information related to the present disclosure and may not constitute prior art.

Furniture can be designed to be open, for example as a shelf, or at least partially closed, with a movable part allowing the furniture to be opened and closed. Doors, lids and drawers with closing fronts are particularly suitable as movable parts. For reasons of convenience, furniture may have moving parts that can be moved by motor between a closed and an open position.

From DE 20 2010 016 982 U1 a movement device for a movable furniture part with at least one actuator for moving the movable furniture part is known. The actuator is driven by an actuating drive in such a way that the movable furniture part can be moved from the closed to the open position and vice versa. The actuating drive is drivingly connected to a first gear wheel and to a second gear wheel. The second gear can pivot the actuator around a pivot axis in such a way that the actuator can move the movable furniture part between a closed position and an open position. In addition, a freewheel is provided between the second gear wheel and the actuating element, which makes it possible to open the movable furniture part manually.

SUMMARY

This section provides a general summary of the disclosure and is not a comprehensive disclosure of its full scope or all of its features.

Based on this, an aspect of the present disclosure is to provide a drive device for moving a movable part of a piece of furniture between a closed and an open position, which can be adjusted either manually or motor-driven and is of compact design. In addition, a fitting arrangement and a piece of furniture with such a drive device is provided.

According to this aspect, a drive device for moving a movable part of a piece of furniture between a closed and an open position comprises a motor pivotally connectable to a body of the piece of furniture via a support assembly, a first threaded element rotationally drivable by the motor and a second threaded element engaged with the first threaded member, the second threaded element being translationally displaced along the first threaded element upon rotation of the first threaded element, and an actuating element, which is arranged displaceably relative to the first threaded element along an axis of motion and has a first stop and a second stop, the second threaded element being arranged axially displaceably relative to the actuating element between the first stop and the second stop of the actuating element, and a fitting element pivotably connected to the actuating element and connectable to the movable part.

The drive device has the advantage that it has a small installation space.

The movable part of the furniture can be designed in particular as a flap, lid, door or drawer.

The first threaded element and the second threaded element may engage with each other directly or indirectly via at least one intermediate element and may, for example, together with the at least one intermediate element, form part of a ball screw drive. The first threaded element may have an external thread, and the second threaded element may have an internal thread, which engages with the external thread of the first threaded element. Alternatively, the first threaded element may have an internal thread, and the second threaded element may have an external thread, which engages with the internal thread of the first threaded element.

One axis of rotation of the motor and one axis of rotation of the first threaded element can be arranged coaxially to the axis of motion. The actuating element can be moved along the axis of motion from a contact with the first stop to a contact with the second stop.

In some variations, the actuating element can be sleeve-shaped, with the first and second stop each extending radially inwards from a hollow cylindrical section. In such variations, the second threaded element may have a slider section, which extends radially outwards from a rod-shaped threaded section and is located axially between the first stop and the second stop of the actuating element. And at least a partial area of the inner contour of the actuating element can be designed to be complementary to an outer contour of at least a partial area of the second threaded element. The partial area of the actuating element can be especially the area between the first stop and the second stop. The partial area of the second threaded element can be especially the slider section.

In such variations, the first stop and the second stop may each have a central opening, the largest inscribed cylinder of which has a smaller diameter than the cylindrical envelope of the second threaded element. The first threaded element can extend through the central opening of the first stop and the second stop. Alternatively, at least the stop of the first stop and the second stop, which faces the motor, may have a central opening through which the second threaded element extends.

Alternatively, in other variations of the present disclosure, the actuating element can be rod-shaped, whereby the first and the second stop each extend radially outwards from a rod section. The second threaded element may have a central opening through which the actuating element extends and whose largest inscribed cylinder is smaller in diameter than the cylindrical envelope of the first stop and the second stop respectively. In particular, the part of the rod section between the first stop and the second stop may extend through the central opening of the second threaded element of the actuating element. Alternatively, the second threaded element may have a slider section extending radially inwards from a hollow cylindrical threaded section and located axially between the first stop in the second stop of the actuating element. In such variations, at least a partial area of an inner contour of the second threaded element may be shaped complementary to an outer contour of at least a partial area of the actuating element.

In some or all of the above-mentioned variations, the first and/or the second stop can be designed as a full circumferential ring or extend only over a part of the circumference.

The support assembly may comprise a bearing element and a housing. The motor can be accommodated in the housing and the housing can be pivotally connected to the body of the furniture via the bearing element. The motor can thus be pivotally connected to the body of the furniture, at least indirectly. The housing can form an accommodation chamber in which the motor is accommodated. The actuating element can be mounted in the housing so that it can be moved axially, especially along the axis of motion. The housing may be made of a single piece and may have a first cylinder section in which the motor is housed and a second cylinder section in which the actuating element is mounted for axial displacement.

Alternatively, the motor can be pivotally connected to the body of the furniture via the bearing element and the housing can be rigidly connected to the body of the furniture. In this case, the housing can also be called a cover element. The housing may enclose at least the first threaded element in such a way that inadvertent contact with the first threaded element is inhibited when the drive device is in the assembled state.

A sensor may be provided to detect a signal representing the longitudinal position of the second threaded element. In particular, the sensor can be designed as a rotation angle sensor for detecting the angular position of the first threaded element and/or the second threaded element.

According to another aspect of the disclosure, a fitting arrangement for pivotally attaching a movable part of a piece of furniture to a body of the piece of furniture comprises a drive device according to one of the aforementioned configurations, and a spring-loaded holding arrangement by which the movable part of the piece of furniture can be fixed in the open position.

The fitting arrangement also has the advantage that it has a small installation space.

According to a further aspect of the present disclosure, a piece of furniture comprises a body, a movable part pivotally mounted to the body, a drive device for moving the movable part between a closed and an open position according to a previously mentioned configuration, and a spring-loaded holding arrangement by which the movable part can be fixed in the open position.

The piece of furniture has the advantage that a small installation space is taken up by the drive device, thus increasing the usable space within the piece of furniture.

In one form of the present disclosure, drive device for moving a movable part of a piece of furniture between a closed position and an open position includes a motor pivotably connectable to a body of the piece of furniture via a support assembly, a first threaded element rotatably drivable by the motor, and a second threaded element engaged with said first threaded element. The second threaded element is translationally displaceable along the first threaded element upon rotation of the first threaded element. An actuating element is included and arranged displaceably relative to the first threaded element along an axis of motion. The actuating element has a first stop and a second stop, and the second threaded element is arranged axially displaceable relative to the actuating element between the first stop and the second stop. A fitting element is also included and pivotally connected to the actuating element and connectable to the movable part of the piece of furniture.

In some variations, an axis of rotation of the motor and an axis of rotation of the first threaded element are arranged coaxially with the axis of motion.

In at least one variation, the support assembly includes a bearing element and a housing, the motor is accommodated in the housing and the housing is pivotably connectable to the body of the piece of furniture via the bearing element. In such variations, the housing forms an accommodation chamber in which the motor is accommodated. In some variations, the actuating element is mounted in the housing such that it is displaced axially along the axis of motion. Also, the housing can have a cylinder section in which the actuating element is mounted such that the actuating element is axially displaceable within the housing.

In at least one variation, the first threaded element has an external thread and the second threaded element has an internal thread which engages with the external thread of the first threaded element.

In some variations, the first stop and the second stop each have a central opening through which the first threaded element is guided. In such variations, an inner contour of at least a partial area of the actuating element can be complementary to an outer contour of at least a partial area of the second threaded element.

In at least one variation the drive device includes a sensor configured for detecting a signal representing the longitudinal position of the second threaded element. The sensor can be a rotation angle sensor configured for detecting the angular position of at least one of the first threaded element and the second threaded element.

In some variations, the drive device includes a spring-loaded holding arrangement configured to fix the movable part of the piece of furniture in the open position.

In at least one variation the moveable part of the piece of furniture is a lid and the fitting element is pivotally connected to the actuating element and connected to the lid.

In another form of the present disclosure, a piece of furniture with a lid movable between a closed position and an open position includes a body, the lid pivotally connected to the body, and a drive device. The drive device includes a motor pivotably connected to the body via a support assembly, a first threaded element rotatably drivable by the motor, and a second threaded element engaged with the first threaded element. The second threaded element is translationally displaceable along the first threaded element upon rotation of the first threaded element. An actuating element arranged displaceably relative to the first threaded element along an axis of motion is included and has a first stop and a second stop. Also, the second threaded element is arranged axially displaceably relative to the actuating element between the first stop and the second stop. A fitting element pivotally connected to the actuating element and connected to the lid is also included.

In some variations, an axis of rotation of the motor and an axis of rotation of the first threaded element are arranged coaxially with the axis of motion.

In at least one variation, the support assembly includes a bearing element and a housing, the motor is accommodated in the housing and the housing is pivotably connected to the body of the piece of furniture via the bearing element. In such variations the housing can have a cylinder section in which the actuating element is mounted such that the actuating element is axially displaceable within the housing along the axis of motion.

In some variations, the first threaded element has an external thread and the second threaded element has an internal thread which engages with the external thread of the first threaded element, the first stop and the second stop each have a central opening through which the first threaded element is guided, and an inner contour of the actuating element is complementary to an outer contour of the second threaded element. In such variations a sensor configured for detecting a signal representing the longitudinal position of the second threaded element can be included and the sensor can be a rotation angle sensor configured for detecting the angular position of at least one of the first threaded element and the second threaded element.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 5:
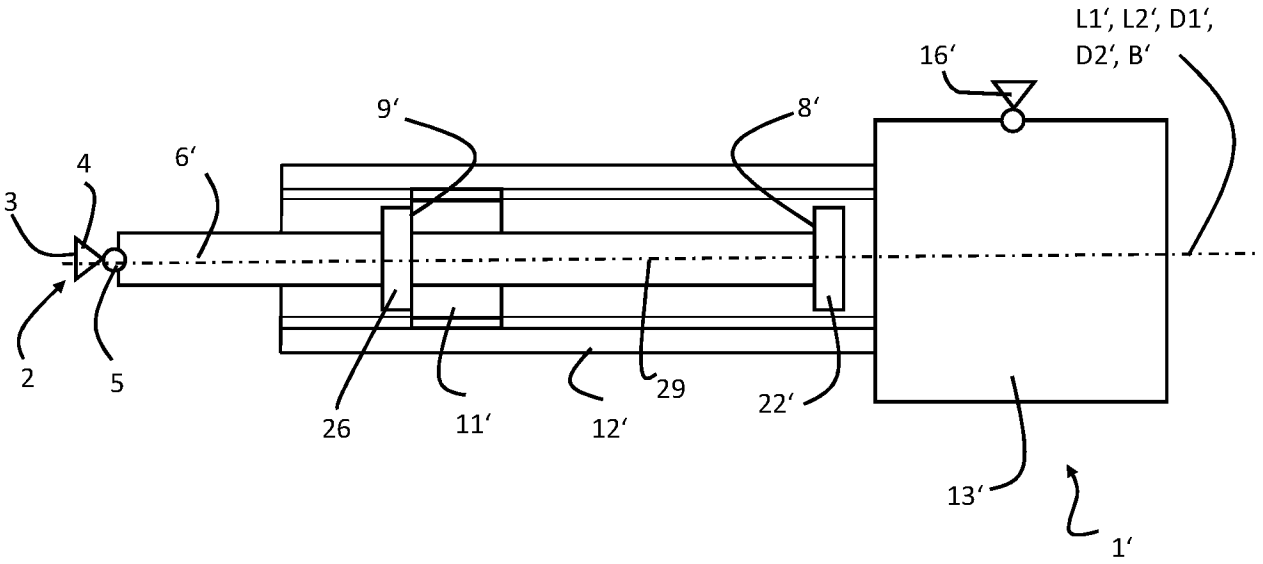
Figure 6:
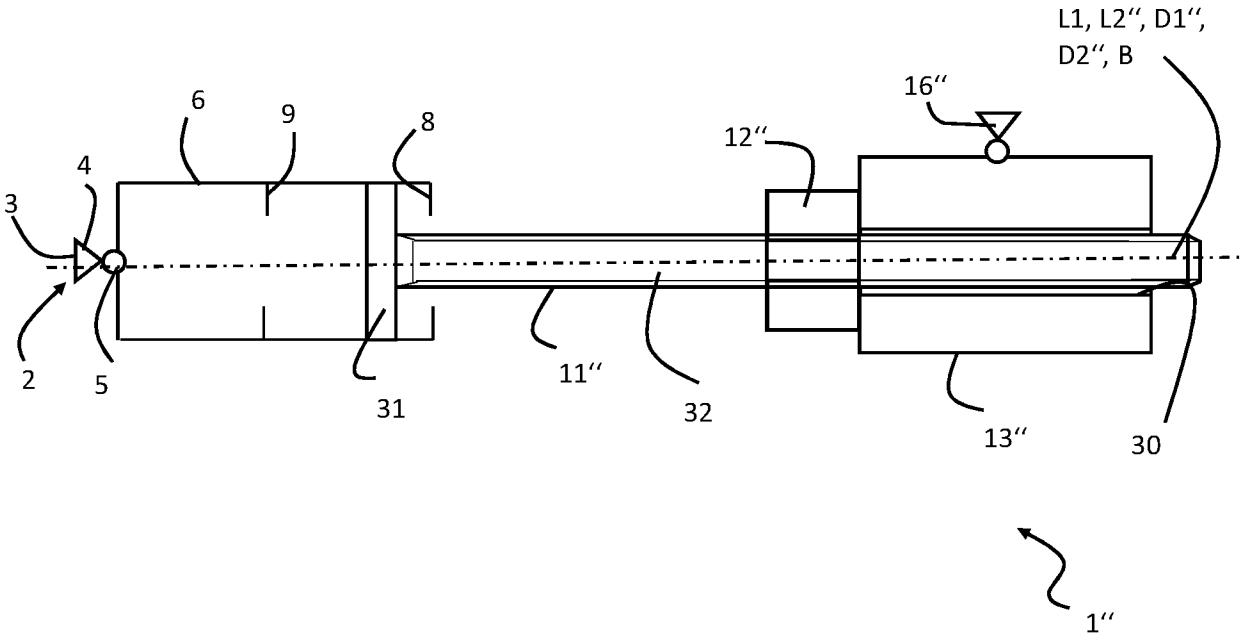

FIG. 5 schematically shows a second form of a drive device,

FIG. 6 schematically shows a third form of a drive device, and

Figure 7:
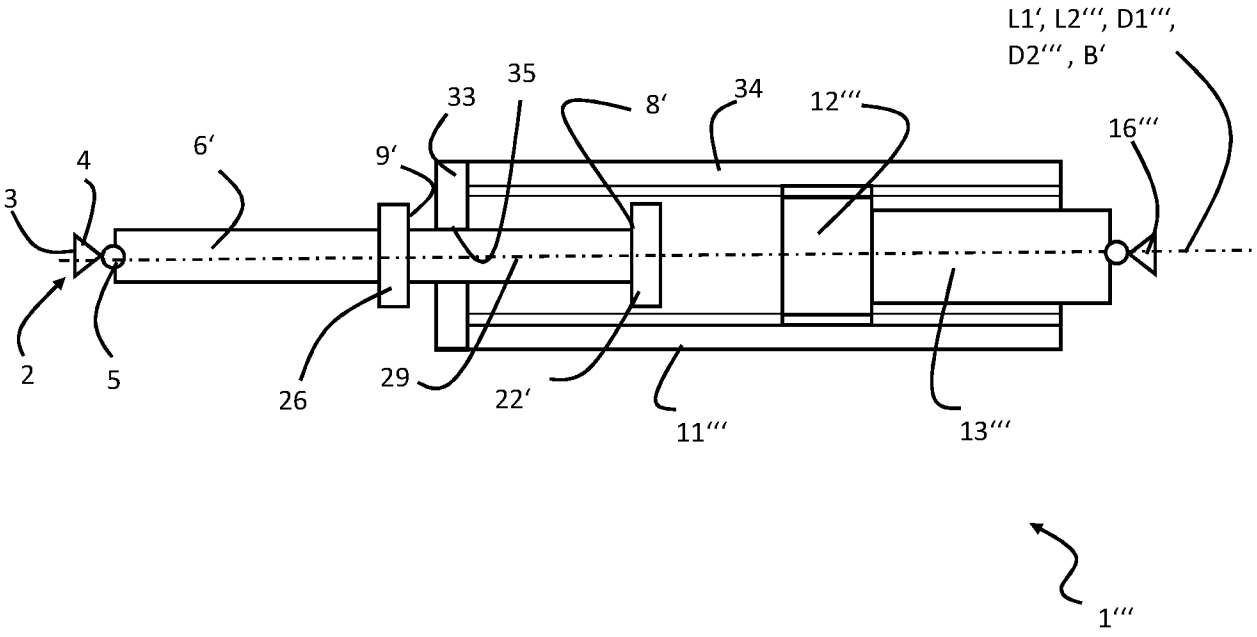

FIG. 7 schematically shows a fourth form of a drive device.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIGS. 1 to 4, which are described together below, show a piece of furniture 17 with a fitting arrangement which has a drive device 1 and a holding arrangement 21 for pivotally attaching a lid 18, as a movable part of the furniture 17, to a body 19 of the piece of furniture 17.

The drive device 1 comprises a fitting element 2 that has two connecting sections 3, 3', which rigidly connect the fitting element 2 to the lid 18 of the piece of furniture 17. The fitting element 2 also has a bearing section 4 in which a pivot element 5 is inserted. For this purpose, the pivot element 5 extends through an opening (not labeled) in the bearing section 4 of fitting element 2. In some variations of the present disclosure, the pivot element 5 is designed as a bolt, however pivot elements different than a bolt can be included and used.

The fitting element 2 is connected to an actuating element 6 via the pivot element 5, which can be pivoted about a first pivot axis (not labeled).

In some variations, the actuating element 6 is tubular and has a longitudinal axis L1. In such variations the actuating element 6 has a cylinder section 7, a first stop 8 and a second stop 9. The actuating element 6 has an opening (not labeled) in which the pivot element 5 is accommodated. The opening of the actuating element 6 is located in a first end area of the cylinder section 7.

The first stop 8 is located in a second end region of the cylinder section 7, which is located opposite the first end region of the cylinder section 7. The first stop 8 is formed by a radially inward, annular shoulder 22. Alternatively, it is also conceivable that shoulder 22 is only formed over part of the circumference.

The second stop 9 is located at an axial distance from the first stop 8 and is formed by a stop sleeve 10. The stop sleeve 10 is designed complementary to the inner contour of the cylinder section 7 of the actuating element 6 and is inserted into the cylinder section 7. The stop sleeve 10 is fixed in axial direction by the pivot element 5. The pivot element 5 engages in receiving recesses of the stop sleeve 10, whereby the receiving recesses are designed complementary to the outer contour of the pivot element 5. Alternatively, it is also conceivable that the stop sleeve 10 is pressed into the cylinder section 7 of the actuating element 6.

The shoulder 22 of the first stop 8 has an opening through which a first threaded element in the form of a threaded rod 12 extends, which can be driven in rotation by a motor 13. An axis of rotation D1 of the motor 13 is arranged coaxially to an axis of rotation D2 of the threaded rod 12. The axis of rotation D2 of the threaded rod 12 in this case is coaxial with the longitudinal axis L2 of the threaded rod 12. The stop sleeve 10 has a continuous opening into which the threaded rod 12 extends. In some variations, the opening of the stop sleeve 10 is closed at the end facing the fitting element 2.

A second threaded element in the form of a spindle nut 11 is located on the threaded rod 12, whereby the spindle nut 11 is arranged axially between the first stop 8 and the second stop 9 of the actuating element 6. The spindle nut 11 has an internal thread which engages with an external thread of the threaded rod 12. The outer contour of the spindle nut 11 is designed complementary to the inner contour of the cylinder section 7 of the actuating element 6 in the area between the first stop 8 and the second stop 9. The inner contour of the cylinder section 7 of the actuating element 6 has a cross-section deviating from a circle at least in the area between the first stop 8 and the second stop 9. The spindle nut 11 is thus moved translationally along the threaded rod 12 when the latter is rotated. The spindle nut 11 is thus arranged so that it can be moved relative to the threaded rod 12 along an axis of motion B. The axis of rotation D1 of the motor 13 and the axis of rotation D2 of the threaded rod 12 are arranged coaxially to the axis of motion B.

A cylindrical envelope of the spindle nut 11 along the axis of motion B has a larger diameter than the largest inscribed cylinder of the opening of the first stop 8 and the opening of the stop sleeve 10 along the axis of motion B. The spindle nut 11 can therefore be brought into axial contact with both the first stop 8 and the second stop 9 by rotating the threaded rod 12 without being able to pass through the opening of the respective stop 8, 9.

The motor 13, the threaded rod 12, the spindle nut 11 and the actuating element 6 are accommodated in a support assembly 14. The support assembly 14 comprises a housing 15 and a bearing element 16. The housing 15 comprises a accommodation chamber 27, in which the motor 13 is mounted rotationally and axially fixed. The housing 15 also includes a cylinder section 28, which is axially adjacent to the accommodation chamber 27, and in which the actuating element 6 is mounted so that it can be moved axially. The motor 13 has a sensor 36 to detect the longitudinal position of the spindle nut 11. The sensor 36 is designed as a rotation angle sensor that measures the angular position of the threaded rod 12. In some variations, the sensor 36 is calibrated after assembly such that the longitudinal position of the spindle nut 11 can be or is determined from the angular position of the threaded rod 12, whereby a first end position of the spindle nut 11, in which the spindle nut 11 is in contact with the first stop 8, and a second end position of the spindle nut 11, in which the spindle nut 11 is in contact with the second stop 9 are determined.

The bearing element 16 is attached to the body 19 of the piece of furniture 17 and is connected to the housing 15 so that it can pivot about a second pivot axis. In some variations, the first pivot axis of pivot element 5 and the second pivot axis of bearing element 16 are arranged parallel to each other.

Figure 3:
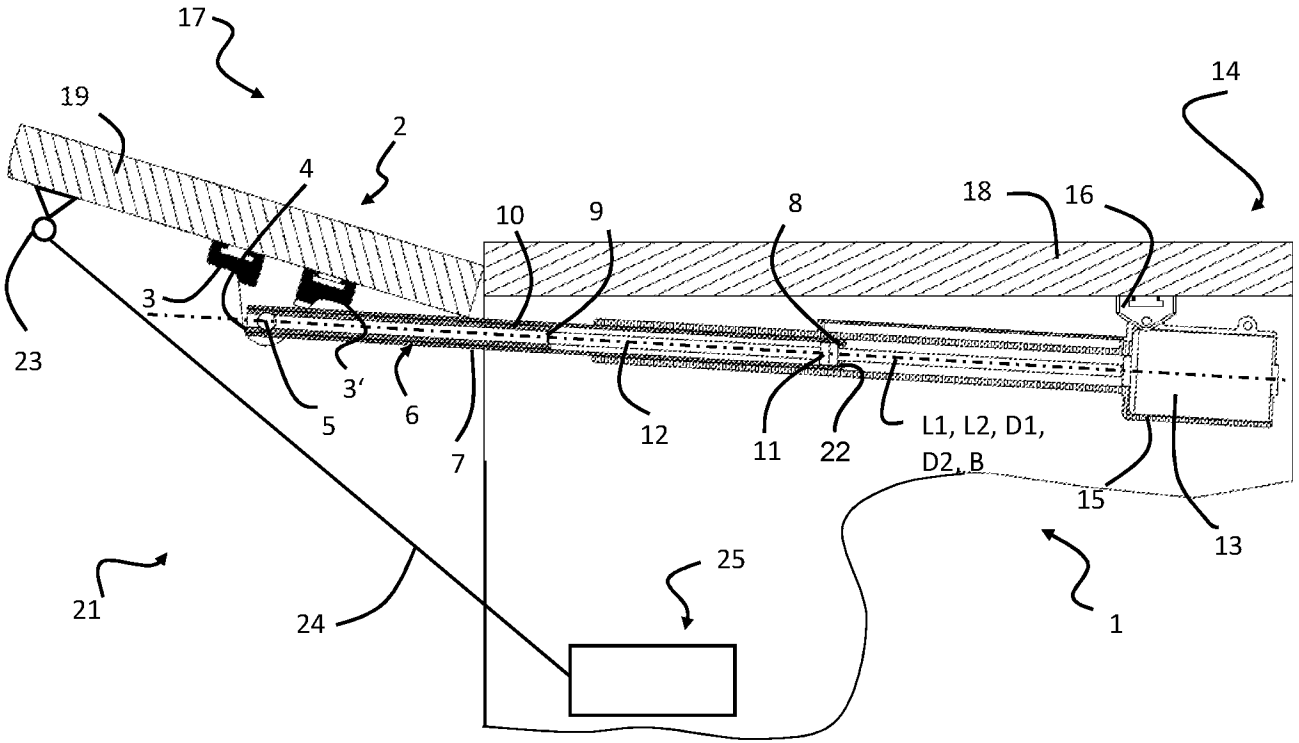
FIG. 3 shows the piece of furniture of FIG. 1 with the drive device in a neutral, open position.

The fitting arrangement also includes a holding arrangement 21, which for the sake of clarity is only shown schematically in FIG. 3. The holding arrangement 21 has a fitting element 23 that is firmly connected to the lid 18 of the piece of furniture 17. An actuating arm 24 is arranged on the fitting element 23, and which can be pivoted around a third pivot axis. The third pivot axis (not labeled) can be arranged parallel to the first pivot axis of pivot element 5 and the second pivot axis of bearing element 16. The actuating arm 24 is connected to the body 19 of the piece of furniture 17 via a spring-bearing arrangement 25 such that the actuating arm 24 can be pivoted about a fourth pivot axis (not labeled). The fourth pivot axis can be arranged parallel to the third pivot axis. The spring-bearing arrangement 25 applies a force to the actuating arm 24 depending on the degree of opening of the lid 18, so that the lid 18 remains at least in the fully open state, i.e. in the open position. In addition, the spring-bearing arrangement 25 can apply a spring force to the actuating arm 24 in a position where the lid 18 closes the body 19 of the piece of furniture 17 in such a way that the lid 18 is held in the closed position. In some variations, the open position of lid 18 is variably adjusted.

Figure 1:
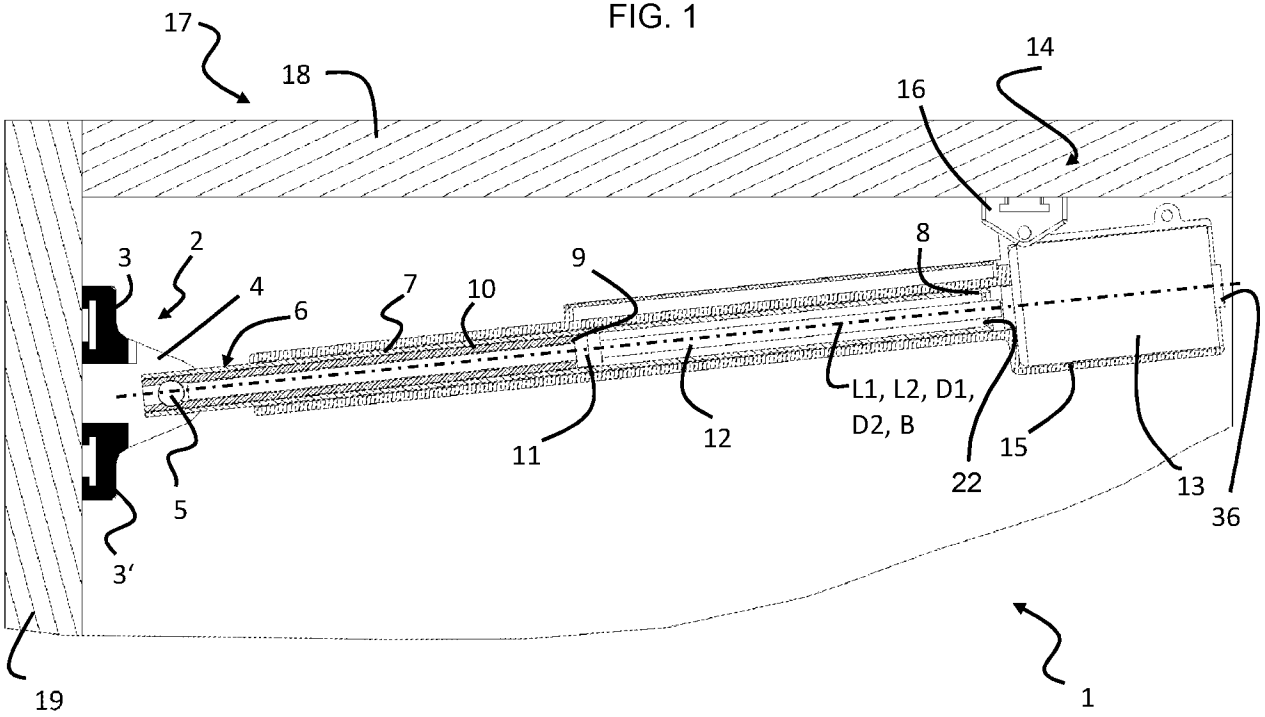
FIG. 1 shows a sectional view of a piece of furniture with a fitting arrangement according to one form of a drive device, the drive device being in a neutral, closed position.

The drive device 1 is shown in FIG. 1 in neutral, closed position. In this case the lid 18 closes the body 19 of the piece of furniture 17. The spindle nut 11 is in axial contact with the second stop 9, whereby the spindle nut 11 exerts an axial force (e.g., a maximum axial force) on the second stop 9, so that the lid 18 just remains in the closed position and does not open. If the threaded rod 12 is now driven by the motor 13 so that the spindle nut 11 is moved in the direction of the fitting element 2, the actuating element 6 moves away from the motor 13 in the axial direction. This movement is transferred from fitting element 2 to the lid 18, so that the lid 18 moves from the closed position to the open position without significant delay. In at least one variation, in the neutral, closed position of the drive device 1, the spindle nut 11 is located at a distance from the second stop 9, whereby the distance must be overcome before opening the lid 18.

In the neutral, closed position of drive device 1, the lid 18 can also be manually transferred to the open position, as the spindle nut 11 does not block the movement of the actuating element 6 in the direction towards the open position.

Figure 2:
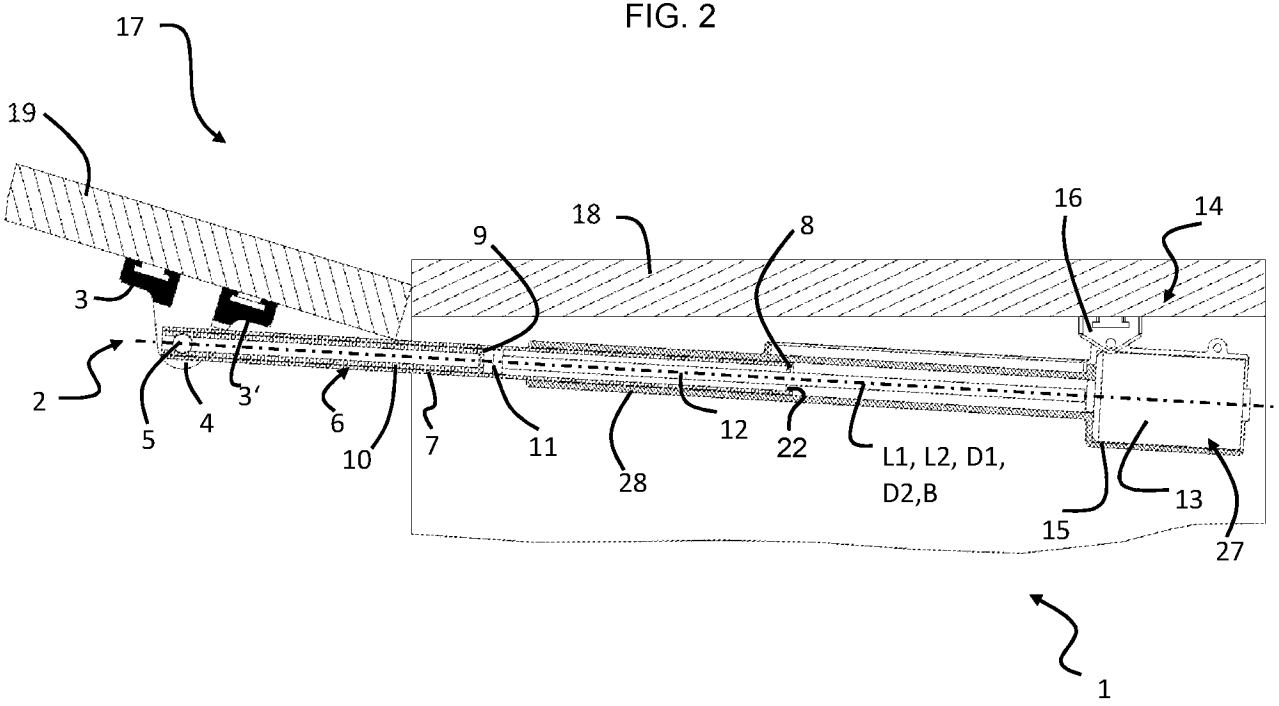
FIG. 2 shows the piece of furniture of FIG. 1 with the drive device in an active, open position.

FIG. 2 shows the drive device 1 in active, open position. Here the lid 18 is in its open position. The spindle nut 11 is still in axial contact with the second stop 9 and exerts an axial force on the second stop 9 so that the lid 18 remains in the open position. In the active, open position, the drive device 1 blocks the lid 18, making it impossible to close the lid 18 manually.

From the active, open position of the drive device 1 shown in FIG. 2, it can be changed to a neutral, open position as shown in FIG. 3. For this purpose, the threaded rod 12 is driven by the motor 13 in such a way that the spindle nut 11 is moved away from the fitting element 2. When the axial force acting from the spindle nut 11 on the second stop 9 is removed, the lid 18 is held in the open position by the holding arrangement 21. The spindle nut 11 is axially displaced until it comes into contact with the first stop 8. In the neutral, open position of the drive device 1, the axial force applied by the spindle nut 11 to the first stop 8 is such that the lid 18 is held in the open position by the holding arrangement 21. Alternatively, in some variations the spindle nut 11 is positioned at a distance from the first stop 8, whereby the distance is overcome before the body 19 of the piece of furniture 17 can be closed by the motor 13 and the lid 18. In the neutral, open position shown in FIG. 3, the drive device 1 does not block the lid 18, so that it can be closed manually by manually overcoming the force applied to the lid 18 by the holding arrangement 21.

Figure 4:
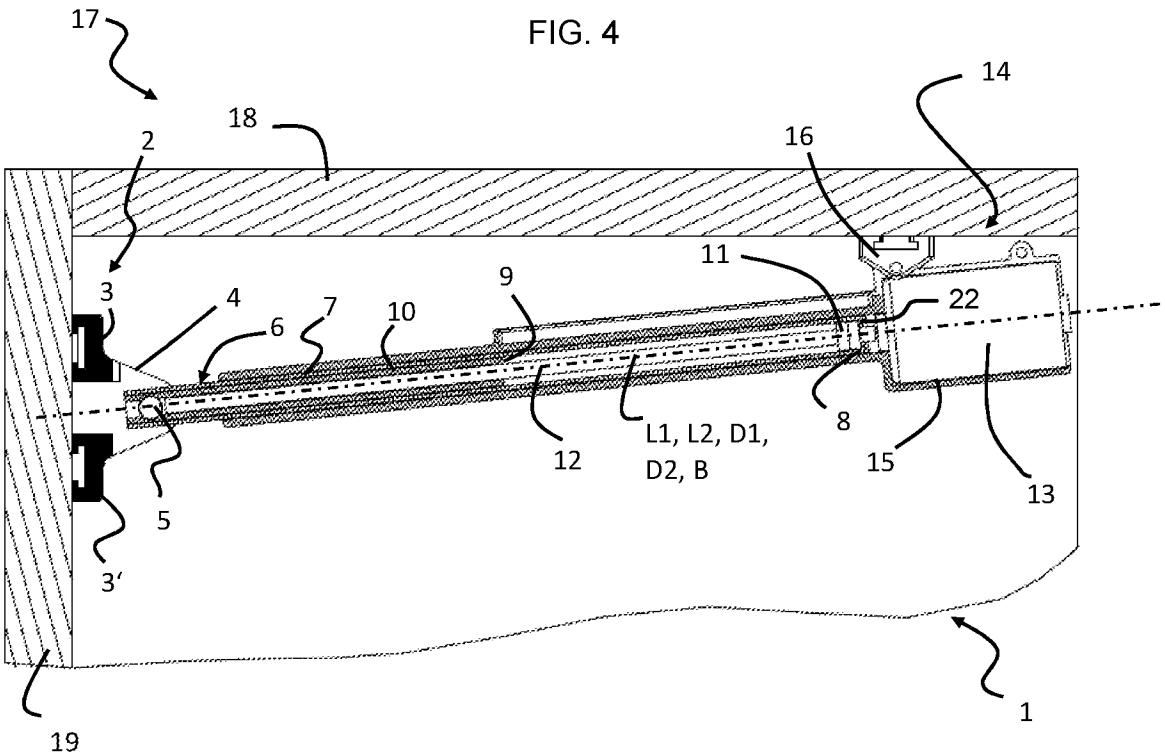
FIG. 4 shows the piece of furniture of FIG. 1 with the drive device in an active, closed position.

In order to close the body 19 of the piece of furniture 17 with the lid 18, the drive device 1 can be moved from the neutral, open position shown in FIG. 3 to the active, closed position shown in FIG. 4. For example, the spindle nut 11 is moved further in the direction towards the motor 13 by rotating the threaded rod 12. This also moves the actuating element 6 in the direction towards the motor 13, whereby this movement is transmitted to the lid 18 via the fitting element 2. In the active, closed position of the drive device 1, the lid 18 completely closes the body 19 of the piece of furniture 17. An axial force is exerted by the spindle nut 11 on the first stop 8, so that the lid 18 is pulled against the body 19 of the piece of furniture 17. In the active, closed position shown in FIG. 4, the spindle nut 11 blocks the lid so that it cannot be manually moved to the open position.

Subsequently, the drive device 1 can be moved from the active, closed position shown in FIG. 4 back to the neutral, closed position shown in FIG. 1.

In the following, drive devices according to a second, third and fourth forms of the present disclosure, are described, which can replace the drive device 1 described above as an alternative. It is understood that these forms can also be transferred to the position described above.

FIG. 5 shows schematically a second form of a drive device 1'. The second form of the drive device 1' differs from the first form of the drive device 1 essentially by the inversion of the geometric relationships of the first threaded element, second threaded element and actuating element. Identical or similar elements are marked with identical reference numbers. With regard to the common features, reference is made at this point summarily to the comments on the first form of the drive device 1.

The drive device 1' comprises the fitting element 2, which can be firmly connected to the lid 18. The fitting element 2 is connected to an actuating element 6' via the pivot element 5, which can be pivoted about a first pivot axis.

The actuating element 6' is rod-shaped and has a rod section 29, a first stop 8' and a second stop 9'. The first stop 8' and the second stop 9' extend radially outwards from the rod section 29. For the assembly of the drive device 1', the actuating element 6' may be composed of two elements, in particular detachably joined, a first element having the first stop 8' and a second element having the second stop 9'.

The actuating element 6' is connected to the pivot element 5 in a first end area. The first stop 8' is located in a second end area of the actuating element 6', which is opposite to the first end area. The first stop 8' is formed by a shoulder 22'. The shoulder 22' is presently detachably connected to the remaining part of the actuating element 6'. The second stop 9' is located at a distance from the first stop 8' and is formed by a shoulder 26.

The actuating element 6' is at least partially arranged in a first threaded element in the form of a threaded hollow shaft 12', which comprises an internal thread. The threaded hollow shaft 12' can be driven by a motor 13'. The axis of rotation D1' of the motor 13' is arranged coaxially to the axis of rotation D2' of the threaded hollow shaft 12'.

The internal thread of the threaded hollow shaft 12' is engaged with an external thread of a second threaded element. The second threaded element is in the form of a spindle element 11' with an external thread and is arranged between the first stop 8' and the second stop 9'. For this purpose, the spindle element 11' has a central through-hole through which the actuating element 6' extends. The spindle element 11' can have an axial extension which is selected so large that the opening of the spindle element 11' forms a sliding bearing for the actuating element 6'. A further element for the movable mounting of the actuating element 6', for example by a housing, is therefore no longer desired.

The inner contour of the opening of the spindle element 11' is shaped complementary to the outer contour of the actuating element 6' in the area between the first stop 8' and the second stop 9'. The outer contour of the actuating element 6' has a different shape from round in the area between the first stop 8' and the second stop 9'. The spindle element 11' can thus be supported in the circumferential direction via the actuating element 6' on the fitting element 2, so that when the hollow threaded shaft 12' rotates, the spindle element 11' is displaced in translation along the hollow threaded shaft 12'. The spindle element 11' can thus be brought into axial contact with the first stop 8' and the second stop 9' in order to move the actuating element 6' axially along an axis of motion B'.

A cylindrical envelope along the axis of motion B' of shoulder 22' and shoulder 26 each has a larger diameter than the largest inscribed cylinder of the opening of spindle element 11'. The spindle element 11' can thus be brought into axial contact with both the first stop 8' and the second stop 9' by rotating the threaded hollow shaft 12'.

The motor 13' can be pivoted around a second pivot axis via a bearing element 16' and is connected to the body 19 of the piece of furniture 17 in a rotationally fixed manner around the axis of rotation D1'. The first pivot axis of pivot element 5 and the second pivot axis of bearing element 16' are arranged parallel to each other.

In addition, a cover element not shown in FIG. 5 may be provided, which can be attached to the body 19 of the piece of furniture 17 and/or the motor 13'. The cover element, in particular together with the body 19, can enclose at least the threaded hollow shaft 12' in such a way that, when the drive device is mounted, inadvertent contact with the rotatable threaded hollow shaft 12' is inhibited or avoided.

FIG. 6 shows schematically a third form of a drive device 1". The third form of the drive device 1" differs from the first form of the drive device 1 essentially by the inversion of the geometric relationships of the first threaded element and the second threaded element. In the third form, the actuating element 6 of the first form can be used as an actuating element without changes. Identical or similar elements are marked with identical reference numbers. With regard to the common features, reference is made at this point summarily to the comments on the first form of the drive device 1.

The drive device 1" comprises a fitting element 2, which can be firmly connected to the lid 18. The fitting element 2 has the pivot element 5. The fitting element 2 is connected to the actuating element 6 via the pivot element 5, so that it can pivot around a first pivot axis.

A first threaded element in the form of a threaded nut 12" has an internal thread and can be driven in rotation by a motor 13". A second threaded element in the form of a threaded rod 11" has an external thread which engages with the internal thread of the threaded nut 12". The axis of rotation D1" of the motor 13" is coaxial to the axis of rotation D2" of the threaded rod 11". The motor 13" has a central opening 30 through which the threaded rod 11" can be moved.

The threaded rod 11" has a threadless slider section 31 at an end facing away from the motor 13", which is adjacent to a rod section 32 on which the external thread is formed. The slider section 31 is located between the first stop 8 and the second stop 9 of the actuating element 6.

The rod section 32 extends through the central opening of the first stop 8. The rod section 32 can have an axial extension which is selected so large that the rod section 32 forms a sliding bearing for the actuating element 6. A further element for the movable mounting of the actuating element 6, for example by a housing, is therefore no longer desired.

The slider section 31 has an outer contour which is complementary to the inner contour of the actuating element 6 in the area between the first stop 8 and the second stop 9 and is different from round. The threaded rod 11" can thus be supported via the slider section 31 and the actuating element 6 on the fitting element 2 circumferential direction, so that when the threaded nut 12" rotates, the threaded rod 11" is displaced in translation along the axis of rotation D2" of the threaded nut 12". The slider section 31 of the threaded rod 11" can thus be brought into axial contact with the first stop and the second stop 9, in order to move the actuating element 6 axially along the axis of motion B.

A cylindrical envelope along the axis of motion B of the slider section 31 has a larger diameter than the largest inscribed cylinder of the opening of the first stop 8 and the second stop 9. The slider section 31 can thus be brought into axial contact with both the first stop 8 and the second stop 9 by rotating the threaded nut 12".

The motor 13" can be pivoted around a second pivot axis via a bearing element 16" and the axis of rotation D1" can be connected to the body 19 of the piece of furniture 17 in a rotationally fixed manner. The first pivot axis of pivot element 5 and the second pivot axis of bearing element 16" are arranged parallel to each other.

FIG. 7 shows schematically a fourth form of a drive device 1'. The fourth form of the drive device 1'" differs from the first form of the drive device 1 essentially by the inversion of the geometric relationships of the first threaded element and the second threaded element. In the fourth form, the actuating element 6' of the second form can be used as an actuating element without changes. Identical or similar elements are marked with identical reference numbers. With regard to the common features, reference is made at this point summarily to the comments on the first form of the drive device 1.

The drive device 1'" comprises the fitting element 2, which can be firmly connected to the lid 18. The fitting element 2 is connected to the actuating element 6' by means of the pivot element 5 so that it can pivot around a first pivot axis.

A first threaded element in the form of a threaded disk 12' has an external thread and can be driven in rotation by a motor 13'. A second threaded element in the form of a threaded hollow shaft 11' has an internal thread which engages with the external thread of the threaded disk 12'''. The axis of rotation Dr of the motor 13''' is coaxial with the axis of rotation D2''' of the threaded hollow shaft 11'.

The threaded hollow shaft 11''' has a threadless slider section 33 at an end facing away from the motor 13''', which is adjacent to a hollow cylinder section 34 in which the internal thread is formed. For mounting the drive device 1''', the slider section 33 can be joined with the hollow cylinder section 34, especially detachably joined. The slider section 33 is located axially between the first stop 8' and the second stop 9' of the actuating element 6'. The slider section 33 has a central opening 35 through which the rod section 29 extends between the first stop 8' and the second stop 9'.

The slider section 33 has an inner contour which is complementary to the outer contour of the rod section 29 of the actuating element 6' in the area between the first stop 8' and the second stop 9' and is different from round. The threaded hollow shaft 11" can thus be supported in the circumferential direction via the slider section 33 and the actuating element 6' on the fitting element 2, so that when the threaded disk 12" rotates, the threaded hollow shaft 11" is displaced in translation along the axis of rotation D2''' of the threaded disk 12'''. The slider section 33 of the threaded hollow shaft 11" can thus be brought into axial contact with the first stop 8' and the second stop 9' in order to move the actuating element 6' axially along the axis of motion B'.

A cylindrical envelope along the axis of motion B' of the shoulder 22' and the shoulder 26 of the actuating element 6' each has a larger diameter than the largest inscribed cylinder of the opening of the slider section 33 of the threaded hollow shaft 11'. The slider section 33 of the threaded hollow shaft 11" can thus be brought into axial contact with both the first stop 8' and the second stop 9' by rotating the threaded disk 12".

The motor 13" can be pivoted around a second pivot axis via a bearing element 16''' and the axis of rotation D1" can be connected to the body 19 of the piece of furniture 17 in a rotationally fixed manner. The first pivot axis of pivot element 5 and the second pivot axis of bearing element 16''' are arranged parallel to each other.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The apparatuses and methods described in this application may be partially or fully implemented by a special purpose computer created by configuring a general-purpose computer to execute one or more particular functions embodied in computer programs. The functional blocks, flowchart components, and other elements described above serve as software specifications, which can be translated into the computer programs by the routine work of a skilled technician or programmer.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A drive device for moving a movable part of a piece of furniture between a closed position and an open position, the drive device comprising:

a motor pivotably connectable to a body of the piece of furniture via a support assembly, a first threaded element rotatably drivable by the motor, a second threaded element engaged with said first threaded element, said second threaded element being translationally displaced along said first threaded element upon rotation of said first threaded element, an actuating element, which is arranged displaceably relative to the first threaded element along an axis of motion and has a first stop portion and a second stop portion, the second threaded element being arranged axially displaceably relative to the actuating element between the first stop portion and the second stop portion of the actuating element, wherein the second threaded element is configured to be brought into axial contact with both the first stop portion and the second stop portion of the actuating element, and a fitting element pivotally connected to the actuating element and connectable to the movable part of the piece of furniture.

2. The drive device according to claim 1, wherein an axis of rotation of the motor and an axis of rotation of the first threaded element are arranged coaxially with the axis of motion.

3. The drive device according to claim 1, wherein the support assembly comprises a bearing element and a housing, the motor being accommodated in the housing and the housing being pivotably connectable to the body of the piece of furniture via the bearing element.

4. The drive device according to claim 3, wherein the housing forms an accommodation chamber in which the motor is accommodated.

5. The drive device according to claim 3, wherein the actuating element is mounted in the housing such that it can be displaced axially along the axis of motion.

6. The drive device according to claim 3, wherein the housing has a cylinder section in which the actuating element is mounted such that the actuating element is axially displaceable within the housing.

7. The drive device according claim 1, wherein the first threaded element has an external thread and the second threaded element has an internal thread which engages with the external thread of the first threaded element.

8. The drive device according to claim 1, wherein the first stop portion and the second stop portion each have a central opening through which the first threaded element is guided.

9. The drive device according to claim 8, wherein an inner contour of at least a partial area of the actuating element is complementary to an outer contour of at least a partial area of the second threaded element.

10. The drive device according to claim 1 further comprising a sensor configured for detecting a signal representing a longitudinal position of the second threaded element.

11. The drive device according to claim 10, wherein the sensor is a rotation angle sensor configured for detecting an angular position of at least one of the first threaded element and the second threaded element.

12. The drive device according to claim 1 further comprising a spring-loaded holding arrangement configured to fix the movable part of the piece of furniture in the open position.

13. The drive device according to claim 1, wherein the movable part of the piece of furniture is one of a flap, lid, door, and drawer.

14. A piece of furniture with a part movable between a closed position and an open position, the piece of furniture comprising:

a body and the part pivotally connected to the body, wherein the part is one of a flap, lid, door, and drawer; and a drive device comprising:

a motor pivotably connected to the body via a support assembly, a first threaded element rotatably drivable by the motor, a second threaded element engaged with said first threaded element, said second threaded element being translationally displaced along said first threaded element upon rotation of said first threaded element, an actuating element arranged displaceably relative to the first threaded element along an axis of motion and having a first stop portion and a second stop portion, the second threaded element being arranged axially displaceably relative to the actuating element between the first stop portion and the second stop portion of the actuating element, wherein the second threaded element is configured to be brought into axial contact with both the first stop portion and the second stop portion of the actuating element, and a fitting element pivotally connected to the actuating element and connected to the part.

15. The piece of furniture according to claim 14, wherein an axis of rotation of the motor and an axis of rotation of the first threaded element are arranged coaxially with the axis of motion.

16. The piece of furniture according to claim 14, wherein the support assembly comprises a bearing element and a housing, the motor is accommodated in the housing and the housing is pivotably connected to the body of the piece of furniture via the bearing element.

17. The piece of furniture according to claim 16, wherein the housing has a cylinder section in which the actuating element is mounted such that the actuating element is axially displaceable within the housing along the axis of motion.

18. The piece of furniture according claim 14, wherein:

the first threaded element has an external thread and the second threaded element has an internal thread which engages with the external thread of the first threaded element, the first stop portion and the second stop portion each have a central opening through which the first threaded element is guided, and an inner contour of the actuating element is complementary to an outer contour of the second threaded element.

19. The piece of furniture according to claim 18 further comprising a sensor configured for detecting a signal representing the longitudinal position of the second threaded element.

20. The piece of furniture according to claim 19, wherein the sensor is a rotation angle sensor configured for detecting the angular position of at least one of the first threaded element and the second threaded element.

* * * * *